US009402143B2

(12) United States Patent
Roth

(10) Patent No.: US 9,402,143 B2
(45) Date of Patent: Jul. 26, 2016

(54) METHOD FOR PROCESSING AN AUDIO SIGNAL, AUDIO PLAYBACK SYSTEM, AND PROCESSING UNIT FOR PROCESSING AUDIO SIGNALS

(75) Inventor: Werner Roth, Stuttgart (DE)

(73) Assignee: Werner Roth, Stuttgart (DE)

( * ) Notice: Subject to any disclaimer, the term of this patent is extended or adjusted under 35 U.S.C. 154(b) by 197 days.

(21) Appl. No.: 14/235,837

(22) PCT Filed: Jul. 25, 2012

(86) PCT No.: PCT/EP2012/064587

§ 371 (c)(1),
(2), (4) Date: Apr. 4, 2014

(87) PCT Pub. No.: WO2013/017502

PCT Pub. Date: Feb. 7, 2013

(65) Prior Publication Data

US 2014/0219457 A1 Aug. 7, 2014

(30) Foreign Application Priority Data

Jul. 29, 2011 (DE) ..... 10 2011 108 788

(51) Int. Cl.
*H04S 7/00* (2006.01)
*H04S 3/00* (2006.01)

(52) U.S. Cl.
CPC . *H04S 7/00* (2013.01); *H04S 3/002* (2013.01); *H04S 3/004* (2013.01)

(58) Field of Classification Search
None
See application file for complete search history.

(56) References Cited

U.S. PATENT DOCUMENTS

2002/0038158 A1 3/2002 Hashimoto et al.
2006/0083383 A1 4/2006 Crundwell et al.
2009/0060237 A1* 3/2009 Konagai ..... H04R 1/403 381/307

FOREIGN PATENT DOCUMENTS

EP 1272004 1/2003
EP 1871143 12/2007

OTHER PUBLICATIONS

German Office Action dated Mar. 14, 2012 in German Patent Application No. 10 2011 108 788.9.
International Search Report and Written Opinion mailed Nov. 22, 2012 in International Application No. PCT/EP2012/064587.
International Preliminary Report on Patentability (including Written Opinion of the ISA) mailed Feb. 4, 2014 in International Application No. PCT/EP2012/064587.

* cited by examiner

*Primary Examiner* — Paul Huber
(74) *Attorney, Agent, or Firm* — Plumsea Law Group, LLC

(57) ABSTRACT

Method of processing an audio signal, audio reproduction system, and processing unit for conditioning audio signals. The audio signal includes at least first and second channels, the first channel being time-delayed by a predetermined delay factor, and a volume level of the first channel being attenuated by a predetermined attenuation factor. This attenuated and time-delayed first channel is added to the second channel to provide a second channel of the audio signal intended for reproduction.

11 Claims, 7 Drawing Sheets

METHOD FOR PROCESSING AN AUDIO SIGNAL, AUDIO PLAYBACK SYSTEM, AND PROCESSING UNIT FOR PROCESSING AUDIO SIGNALS

The present invention relates to a method of processing audio signals, an audio reproduction system including at least two loudspeakers arranged spatially at a distance, and a processing unit for conditioning audio signals.

Part of spatial sensory perception consists in spatial acoustic perception, i.e. spatial hearing. The position of a sound source in the environment is determined based on the binaural (relating to both ears) differences in the sound pressure, for one thing, and the binaural time differences, for another. If a listener does not observe a difference in propagation time between a signal or noise perceived in his/her right and left ears, that is, the respective sound event arrives at both ears of the person at the same time, the sound source is perceived as forward, i.e. in the viewing direction. For example, in the case of sound signals incident from obliquely from the front, that part of the signal which is perceived by the ear facing away from the sound source needs to travel around part of the periphery of the head before the signal is perceived in this ear. This results, inter alia, in a propagation time difference between the ear facing the sound source and the ear facing away from the sound source. In addition to a binaural time difference, in most cases there is furthermore a binaural intensity difference. This means that a difference exists between the sound pressure level perceived by one ear and the sound pressure level perceived by the opposite ear. These binaural intensity and time differences allow the position in space of a sound source to be detected, with the localization acuity being high in the viewing direction and decreasing toward the sides. In other words, it is easier—purely acoustically—to locate a sound source situated in the viewing direction than a sound source existing on the side.

Multi-channel sound systems benefit from the psychoacoustic phenomena explained. The oldest and best-known multi-channel sound system is stereophony, which manages with two loudspeakers. A further development is constituted by quadrophony, which operates with four loudspeakers. This technology, which is insignificant in practice, is an important predecessor technology for today's surround sound systems such as the known 5.1 or 7.1 surround systems.

By way of example, FIG. 1 shows a schematic loudspeaker arrangement 3 of a 5.1 surround system. In addition to right and left main loudspeakers R, L, this arrangement includes a center loudspeaker C arranged in the viewing direction of the listener H and right and left surround loudspeakers RS, LS arranged at the back of the listener H. Preferably, the right and left main loudspeakers R, L are arranged at an angle of +30 degrees and −30 degrees, respectively, in relation to a center axis A. The surround loudspeakers RS, LS are arranged at an angle of between +100 degrees and +120 degrees and −100 degrees and −120 degrees, respectively, in relation to the center axis A. The loudspeakers R, C, L, RS, LS of the surround system are driven by separate, i.e. different signals or channels. In this way, a spatial sound field can be generated by differences in propagation time and intensity between the individual channels. Depending on the binaural differences in propagation time and intensity perceived by the listener H, he/she will perceive a phantom sound source. This virtual sound source is perceived by the listener H as being positioned between the actually emitting loudspeakers. Basically, such a phantom sound source may be situated at any desired position within a panoramic plane spanned by the loudspeakers R, C, L, RS, LS.

In stereo reproduction (e.g., via headphones) of an audio source which has a multitude of surround channels, problems may, however, appear in a reduction to two stereo channels, the so-called "downmixing". A solution proposed by US 2010/0166238 A1 pursues the approach of first subjecting the individual channels of the surround signal to a frequency filtering which is derived from the head-related transfer function (HRTF). Then the individual channels of the surround signal are time-delayed and mixed. A stereo signal having a virtual surround sound is obtained from this mixing of the surround channels.

In a real surround sound audio system as shown in FIG. 1, however, the individual channels of the surround signal are reproduced over separate loudspeakers. The surround sound experience produced by the binaural propagation time and intensity differences is optimally ensured within the so-called "sweet spot". In FIG. 1, the listener H shown is in an optimum position within this sweet spot which, however, is fairly small. The surround sound experience is sometimes unstable with respect to head movements of the listener H. Even the slightest of head movements leads to localization problems and sound distortions since the propagation times and intensities of the individual signals reproduced by the loudspeakers R, C, L, RS, LS change before arriving at the ears of the listener H. So-called comb filter effects may be produced. When a signal is additively superimposed by a time-delayed copy of itself, a comb-filtered signal is produced. Cancellations of individual frequencies or groups of frequencies occur. Also, even small turning movements of the head and forward and backward movements of the head will result in a noticeable instability in relation to the localization of the phantom sound source. In particular phantom sound sources present on the side seem to "jump" even in the case of small forward and backward movements of the head because the propagation time and level differences perceived greatly change. This irritating effect is the cause that lateral sources are perceived to be little stable and rather fleeting.

It is the object of the invention to indicate a method of processing an audio signal, an audio reproduction system, and a processing unit for conditioning audio signals, which are improved in view of the problems known in the prior art.

According to a first embodiment, a method of processing an audio signal is indicated. The audio signal includes at least first and second channels. According to the method, the first channel may be time-delayed by a predetermined delay factor. Furthermore, a volume level of the first channel may be attenuated by a predetermined attenuation factor. This attenuated and time-delayed first channel may be added to the second channel to provide a second channel of the audio signal intended for reproduction.

In the context of this description, the term "channel", strictly speaking, always means the audio signal of the channel concerned. This signal is attenuated and time-delayed and added to the audio signal of a further channel. For reasons of better readability, however, reference will be made in the following merely to a channel which is attenuated, time-delayed and mixed with a further channel. The terms "attenuated" and "time-delayed" relate to the signal of the corresponding channel in its shape originally intended for reproduction. This signal is thus attenuated and time-delayed compared with its original shape.

Preferably, the method is applied to audio signals which are intended for reproduction in a multi-channel or surround sound audio reproduction system, e.g. a surround system. In a minimal configuration, however, it is sufficient if only two loudspeakers, arranged spatially at a distance from each other, of such a multi-channel system are considered and modified in accordance with the features mentioned. In this connection, the concept is not limited to audio reproduction systems the loudspeakers of which are arranged in a two-dimensional panoramic plane. It may equally be extended to audio reproduction systems which comprise additional loudspeakers, if desired, which are arranged at a distance from the panoramic plane. These additional loudspeakers may span further reproduction planes which, with respect to the cited features of the method, are to be treated in the same manner as the horizontal panoramic plane. The same applies to vertical planes in such a three-dimensional audio system.

With the aid of the method mentioned, the reflections, occurring in real rooms, of sound signals, e.g. on walls or on the ceiling, which are typically time-delayed and attenuated in comparison with the original shape of the signal, can, inter alia, be at least partly modeled. These measures allow an improved surround sound experience to be achieved. Here, the method is not limited to real sound sources in real rooms. It equally works for synthetic or virtual sound sources as well.

The method advantageously effects a space and localization stabilization of point-shaped and three-dimensional phantom sound sources. These phantom sound sources may be in a resting state or in a moving state. In the case of a loudspeaker reproduction using the method, the sources become markedly less sensitive to head movements and changes in the monitoring point. In other words, the sweet spot can be enlarged.

The method can basically be applied at any point in time in the production process or else at the ultimate consumer, and irrespectively of the recording, reproduction method and medium (such as, e.g., CD-ROM, DVD video, DVD audio, BlueRay, etc.). It is also possible to divide the individual method steps and carry them out separately at different points of the production process or at the ultimate consumer. In recording, the method may be realized, for example, by appropriate miking techniques, hardware and/or software, or by room-acoustical measures. During the post-production process or during the mastering process, a hardware and/or software implemented realization suggests itself in particular. This also holds true for the ultimate consumer, where the method can be carried out by an audio reproduction system; again, a hardware and/or software implementation suggests itself. The method according to aspects of the invention may also be made use of in surround headphone methods for an improved localization, in particular of moving sources.

According to a further development of the method, the audio signal may include a multitude of channels. These channels are preferably intended for reproduction over a loudspeaker arrangement for spatial reproduction of the audio signal. The loudspeaker arrangement involved may be suitable for quadrophony or the successor technologies thereof, e.g., Surround 5.1 or 7.1, dts, etc. First and second channels of the audio signal may be mixed. Here, the first and second channels may be intended for such loudspeakers of the loudspeaker arrangement which are opposite each other in relation to an axis of reflection of the loudspeaker arrangement.

Relating to a loudspeaker arrangement suitable for quadrophony or the successor technologies thereof, this means that the audio signal includes at least four audio channels for reproduction over loudspeakers of this loudspeaker arrangement. One loudspeaker each of this loudspeaker arrangement may be provided in a respective quadrant of a coordinate system which is formed by a first axis of reflection that is oriented in the direction of a center axis and by a second axis of reflection that is oriented transversely thereto. The first and second channels may be intended for those loudspeakers which are provided in quadrants that are adjacent to each other in relation to one of the first and second axes of reflection.

Advantageously, an improved stability of localization can be achieved in particular in the lateral area. This improved, so-called lateral stability may be obtained, e.g., in that the channels provided in such an audio reproduction system are reflected at the center axis as the first axis of reflection and are added to the channels of the loudspeakers opposite with respect to the center axis. A further possibility resides in mixing the channels of the front main loudspeakers with those of the rear surround loudspeakers. In this way, the signals are reflected at a second axis of reflection. As a matter of course, not only a reflection "from the front to the back" is possible, but also vice versa, a reflection "from the back to the front", i.e. the channels of the surround loudspeakers are added to those of the main loudspeakers.

Preferably, however, no mixing of individual channels with further individual channels occurs—which is basically conceivable. The audio signal preferably includes at least two pairs of stereo channels which, each in pairs, produce first and second stereoscopic images. First and second channels of the first stereoscopic image may each be time-delayed by a predetermined delay factor, and the volume levels of the first and second channels of the first stereoscopic image may each be attenuated by a predetermined attenuation factor. These attenuated and time-delayed stereo channels of the first stereoscopic image may be added to the corresponding first and second stereo channels of the second stereoscopic image to provide a stereoscopic image intended for reproduction.

If the loudspeaker arrangement includes, for example, at least right and left main loudspeakers and right and left surround loudspeakers which are arranged to the right and left of a center axis, the channels of the main and surround loudspeakers arranged on one side of the center axis may be mixed with the channels of the main and surround loudspeakers arranged opposite in relation to the center axis.

For example, the stereoscopic image of the right main and surround loudspeakers may be mixed with the stereoscopic image of the left main and surround loudspeakers. In doing so, the stereoscopic image originally intended for the right side is attenuated and time-delayed, so that the left loudspeakers can now reproduce both the channels intended for them and the attenuated and time-delayed right channels. The same applies to coupling the left stereoscopic image into the right one.

But not only a mixing of the lateral channels is possible. According to a further embodiment, the channels of the main loudspeakers may be mixed with the channels of the surround loudspeakers situated on the same side of the center axis. This produces a reflection of the front stereoscopic image to the back (i.e. on the surround loudspeakers), and vice versa.

Apart from (if desired, also additionally to) a reflection of the stereoscopic images, the mono sum of individual loudspeakers which have a common correlation, e.g., form a common stereo plane, may also be reflected.

If the audio signal includes at least two pairs of stereo channels which, each jointly, produce first and second stereoscopic images, a mono sum may be formed from the first and second stereo channels of one of the two stereoscopic images. This mono sum may be time-delayed by a predetermined delay factor. Furthermore, the volume level of the mono sum may be attenuated by a predetermined attenuation factor. This attenuated and time-delayed mono sum may be added to at least one of the first and second stereo channels of the second channel to provide a second channel intended for reproduction.

Relating to a loudspeaker arrangement suitable for quadrophony or the successor technologies thereof, the audio signal which includes at least four audio channels for reproduction over loudspeakers of this loudspeaker arrangement may be mixed accordingly. Specifically, the mono sum of the channels of the main loudspeakers may be mixed with one or both channels of the surround loudspeakers.

In addition, the mono sum of the channels of a main loudspeaker situated on a first side of the center axis and of a surround loudspeaker situated on the same side of the center axis may be mixed with one or both channels of the main and, respectively, surround loudspeakers situated opposite in relation to the center axis.

Similarly to the stereoscopic images, the mono sum can thus also be reflected both laterally, i.e. "from the right to the left", or vice versa, and also "from the front to the back", and vice versa.

It has been found to be advantageous if, in accordance with one exemplary embodiment, the delay is preferably between 1.5 ms and 20 ms. It has further turned out to be advantageous to select delays of between 8 ms and 15 ms to achieve a corresponding improvement of the surround sound experience and an improved lateral stability. Further delay values may preferably be between 8 ms and 10 ms. A delay of 10 ms may also be selected. According to a further exemplary embodiment, the attenuation of the signal may amount to between −3 dB and −12 dB, preferably between −6 dB and −9 dB, but also exactly −6 dB or −9 dB.

Moreover, the above-mentioned values may be adjusted to the listening situation. In this connection, the size of the room utilized for the reproduction and the desired size of the sweet spot may play a role, inter alia. For a movie theater, for example, a different selection of the delay and attenuation used will be made than for an audio system used by an individual. In addition, the loudspeaker setting used, which takes into account the distance between the loudspeakers and the listener, the type of arrangement of the loudspeakers, and the distance of the loudspeakers among other each, for example, may be taken into account in selecting the delay and attenuation used.

According to a further aspect of the invention, an audio reproduction system is indicated which includes at least two loudspeakers arranged spatially at a distance from each other and a processing unit for processing an audio signal. The audio signal includes at least first and second channels which are intended for reproduction over different ones of the loudspeakers arranged spatially at a distance. The processing unit may be designed to time-delay the first channel by a predetermined delay factor and to attenuate a volume level of the first channel by a predetermined attenuation factor. This attenuated and time-delayed first channel may be added to the second channel to provide a second channel of the audio signal intended for reproduction.

Furthermore, according to a further aspect of the invention, provision is made for a processing unit for conditioning audio signals. This unit includes an input for receiving an audio signal having at least two channels and a unit for processing the audio signal. This unit may be implemented both by hardware and by software. It is preferably designed to time-delay the first channel by a predetermined delay factor and to attenuate a volume level of the first channel by a predetermined attenuation factor. This attenuated and time-delayed first channel may be added to the second channel to provide at an output of the processing unit a second channel of the audio signal intended for reproduction.

Like or similar advantages which have already been indicated in respect of the method according to features of the invention apply equally or similarly to the audio reproduction system and the processing unit according to various embodiments of the invention and therefore require no further explanation.

The invention will now be explained in more detail below with reference to the drawings, which show preferred exemplary embodiments and in which.

Figure 1:
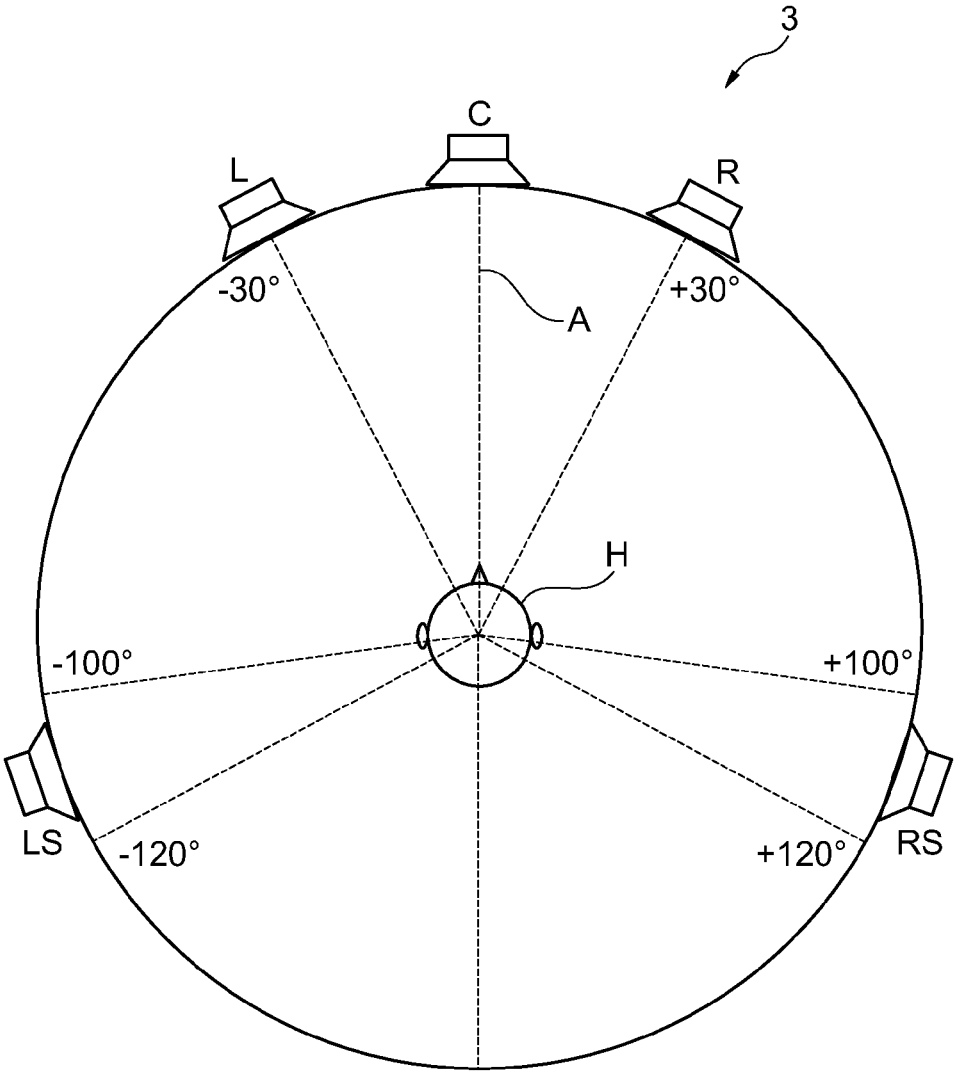
FIG. 1 shows a schematic top view of the loudspeaker arrangement of a 5.1 surround system according to the prior art.
Figure 7:
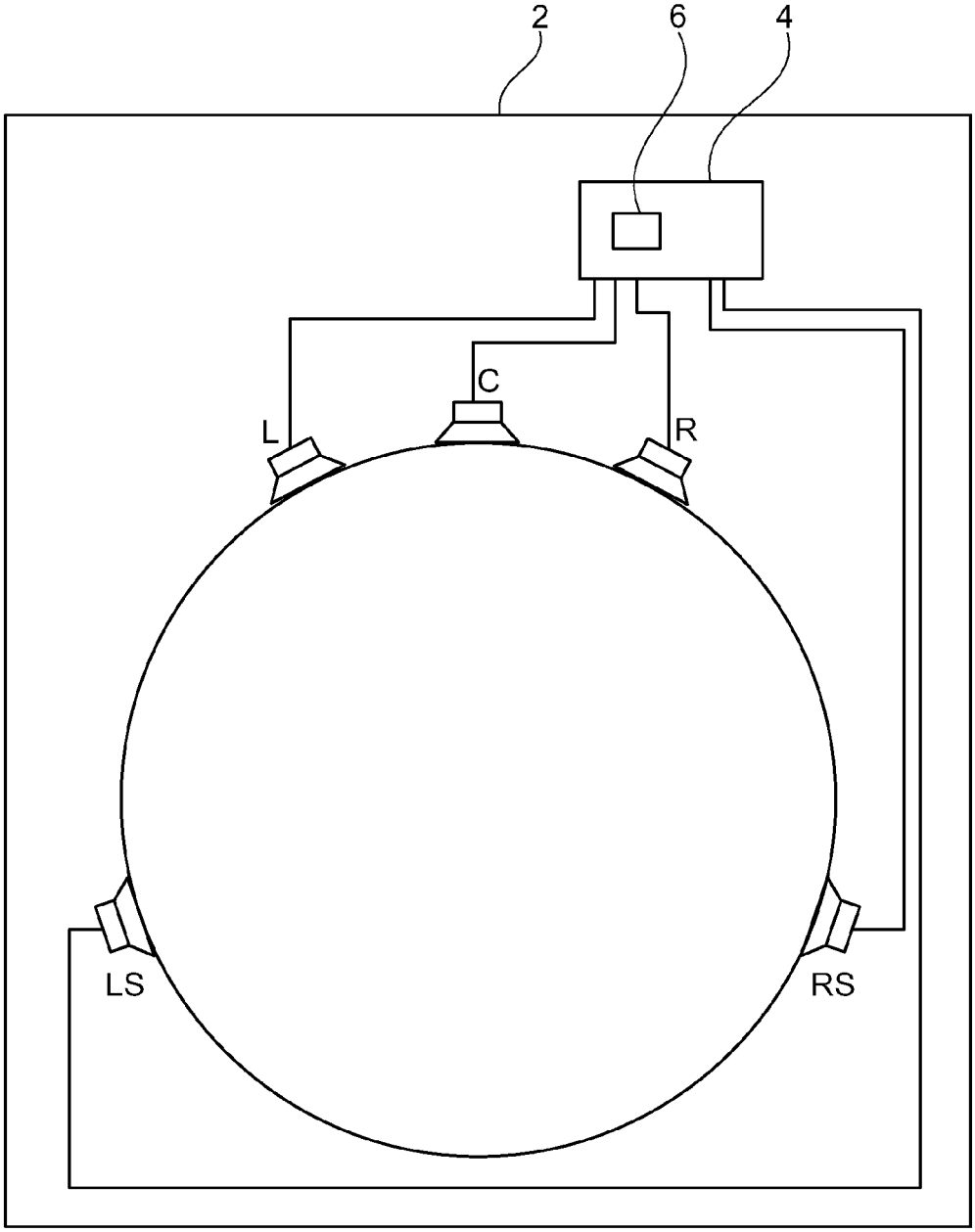
FIG. 7 shows a schematic view of an audio reproduction system according to an exemplary embodiment.

In the loudspeaker arrangement 3 shown in FIG. 1, right and left main loudspeakers R, L are arranged at an angle of +30 degrees and −30 degrees, respectively, in relation to a center axis A. The system may additionally comprise a center loudspeaker C, which is supplemented by a subwoofer, if desired. Situated at the back of the listener H are right and left surround loudspeakers RS, LS, which are arranged at an angle of between +100 degrees and +120 degrees and, respectively, −100 degrees and −120 degrees, in relation to the center axis A. The listener H is at the center of the loudspeaker arrangement 3, where the sweet spot is situated in which a spatial listening experience can be perceived optimally. The loudspeaker arrangement 3 shown may be part of an audio reproduction system 2 as is shown in FIG. 7; the mode of operation thereof will be explained with reference to FIGS. 2 to 5 below.

Figure 2:
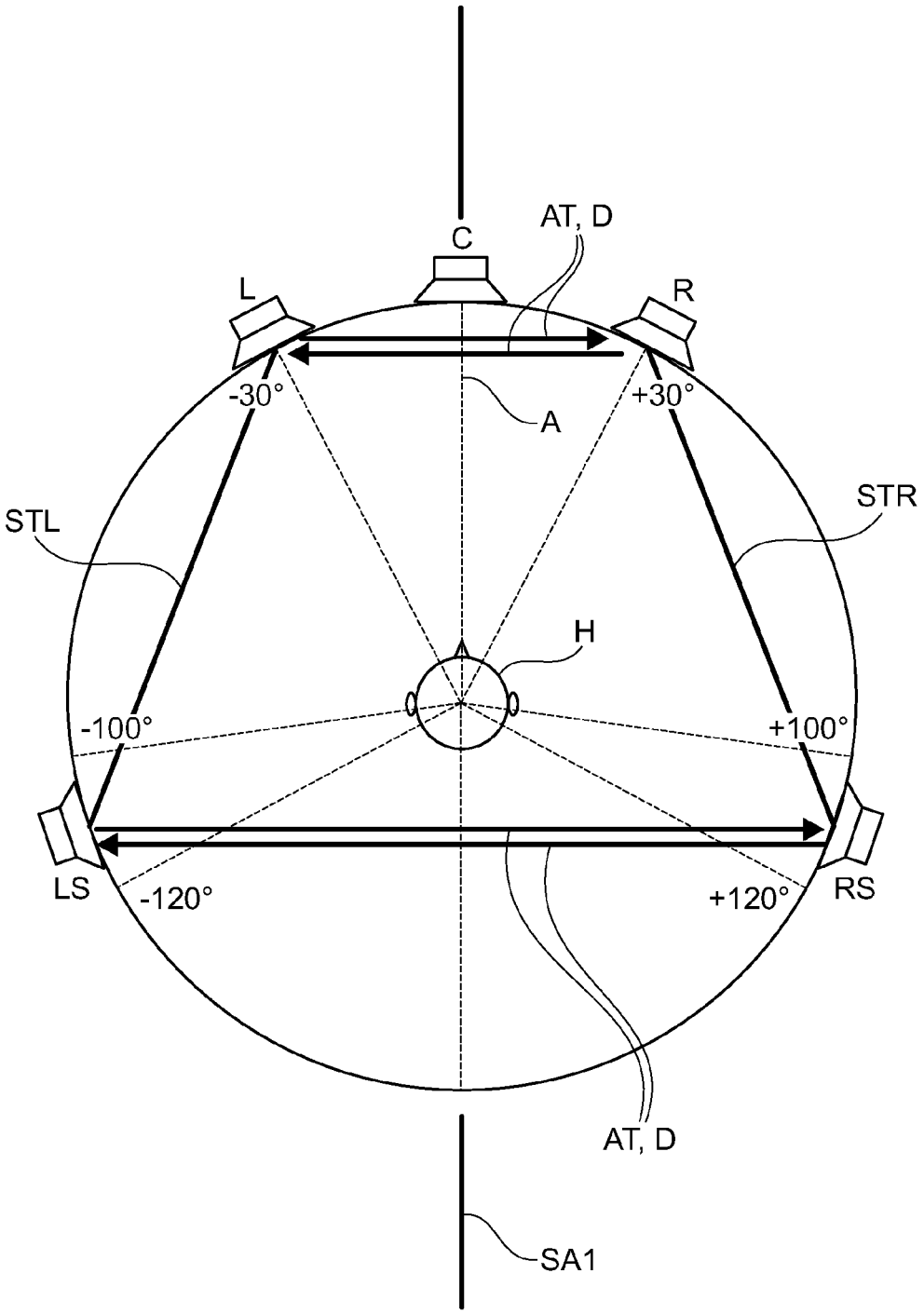
FIGS. 2 to 5 show the mixing and coupling of individual channels as is performed in an audio system according to various exemplary embodiments.

As indicated by arrows in FIG. 2, in an audio reproduction system 2 according to an exemplary embodiment, the channel of the right main loudspeaker R is placed on the left main loudspeaker L in a time-delayed and attenuated form. In this way, the left main loudspeaker L can reproduce both the channel intended for it (e.g., the left stereo channel) and the attenuated and time-delayed stereo channel of the right main loudspeaker R. The same applies correspondingly to the right surround loudspeaker RS, the signal of which is placed on the left surround loudspeaker LS in an attenuated and time-delayed form. In other words, the channels of the main and surround loudspeakers R, L, RS, LS are reflected at the center axis A, which corresponds to a first axis of reflection SA, taking into account the attenuation and time delay. The attenuation factor AT by which the channel of the right main loudspeaker R and the channel of the right surround loudspeaker RS are attenuated is, for example, −9 dB. The time delay by which the channel of the right main loudspeaker R and the channel of the right surround loudspeaker RS are placed on the loudspeakers that are opposite with respect to the center axis A, namely the left main loudspeaker L and the left surround loudspeaker LS, respectively, is determined by a delay factor D which may amount to 10 ms, for example.

When both the channel of the right main loudspeaker R and the channel of the right surround loudspeaker RS are mixed with the channel of the respectively opposite loudspeaker L, LS, the right stereoscopic image STR is ultimately added to the left stereoscopic image STL. The stereoscopic images STR, STL are each indicated by a connecting line between the main and surround loudspeakers R-RS, L-LS.

In the same way in which the channel of the right main loudspeaker R is added to the channel of the left main loudspeaker L that is opposite with respect to the center axis A and the channel of the right surround loudspeaker RS is added to the channel of the left surround loudspeaker LS that is opposite with respect to the center axis A, it is also possible, vice versa, to add the channel of the left main loudspeaker L to the channel of the right main loudspeaker R and to add the channel of the left surround loudspeaker LS to the channel of the right surround loudspeaker RS. These channels are attenuated by the attenuation factor L and time-delayed by the delay factor D as well.

In other words, this means that the right stereoscopic image STR is reflected to the left in an attenuated and time-delayed form, and the attenuated and time-delayed left stereoscopic image STL is reflected to the right.

The audio reproduction system 2 according to the exemplary embodiment mentioned has a sweet spot that is larger compared with that of known systems. In this way, the spatial sound reproduction or the spatial sound impression becomes more tolerant toward a forward or backward movement and also toward a turning of the head of the listener H. Furthermore, the lateral localization can be stabilized so that phantom sound sources which are situated in the area of +90 degrees or −90 degrees can be localized better and an undesirable and irritating "jumping" of these phantom sound sources can be prevented.

The attenuation of the channels is preferably selected to be so large that the audio signals of the reflected channels will not be consciously perceived in the mixed signal. In other words, the listener H will consciously perceive, e.g., only the audio signal of the left main loudspeaker L, but not the signal of the right main loudspeaker R added to this channel. The delay and attenuation values D, AT are preferably selected such that the audio signal that is respectively projected, i.e. reflected at the first axis of reflection SA1 in FIG. 1, attenuated and time-delayed, is not consciously perceivable at least in the sweet spot. In combination with the time delay selected, this creates an acoustic impression which comes very close to the listening experience in real rooms, in which there is always an appearance of acoustic reflections.

A further exemplary embodiment is explained with reference to FIG. 3. In this embodiment, the channels of the right and left main loudspeakers R, L are mixed in an attenuated and time-delayed form with the respective channel of the right and, respectively, left surround loudspeakers RS, LS. When both the channel of the right main loudspeaker R and the channel of the left main loudspeaker L are reflected at the second axis of reflection SA2 and added to the channels of the surround loudspeakers RS, LS, the front stereoscopic image STV is—in other words—reflected to the back and added to the rear stereoscopic image STH of the surround loudspeakers RS, LS. The front and rear stereoscopic images STV, STH are indicated by connecting lines between the main loudspeakers R-L and the surround loudspeakers RS-LS, respectively.

In the same way in which the channels of the front main loudspeakers R, L can be mixed with the channels of the rear surround loudspeakers RS, LS, the channels of the rear surround loudspeakers RS, LS may, of course, also be added to those of the front main loudspeakers R, L, vice versa or, if desired, additionally. When this is effected for both the right and left channels, the rear stereoscopic image STH, just like the front one, is also reflected at the second axis of reflection SA2 and added to the front stereoscopic image STV—in a time-delayed and attenuated form.

Figure 3:
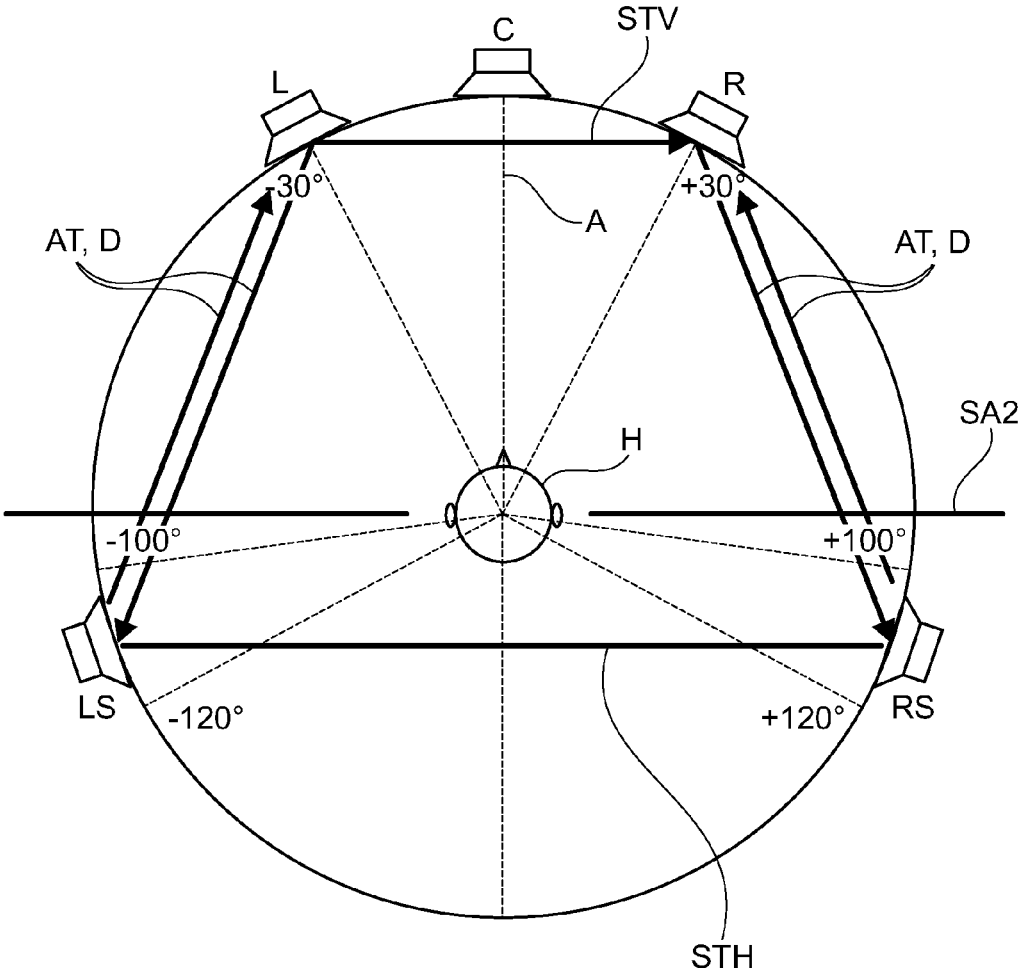

Comparing the exemplary embodiments in FIGS. 2 and 3, the values for the delay D and for the attenuation AT by which the channels are reflected at the first and second axes of reflection SA1 and SA2, respectively, may be the same, but may also be different. In both cases, however, the delay values D are preferably between 1.5 ms and 20 ms. Further preferred limit values for the delay D are at 8 ms and 15 ms, and at 8 ms and 10 ms. Moreover, the delay D may preferably amount to 10 ms. The attenuation factor AT may preferably be between −3 dB and −12 dB. An interval that is also preferred is between −6 dB and −9 dB. Furthermore, it is preferred for the attenuation factor AT to amount to −6 dB or −9 dB. To achieve optimum results, however, the values for the delay D and the attenuation AT should be adjusted to the loudspeaker arrangement 3 that is used; in this connection, particular attention should be paid to the distance of the loudspeakers R, L, RS, LS from the listener H.

It is, however, not only possible to reflect the respective stereoscopic image STL, STR, STV or STH at the corresponding axis of reflection SA1 and SA2, respectively. Alternatively or additionally, a mono sum formed of two channels of the audio signal may also be reflected, in an attenuated and time-delayed form, at one of the axes of reflection SA1 and SA2. Corresponding exemplary embodiments are discussed with reference to FIGS. 4 and 5.

Figure 4:
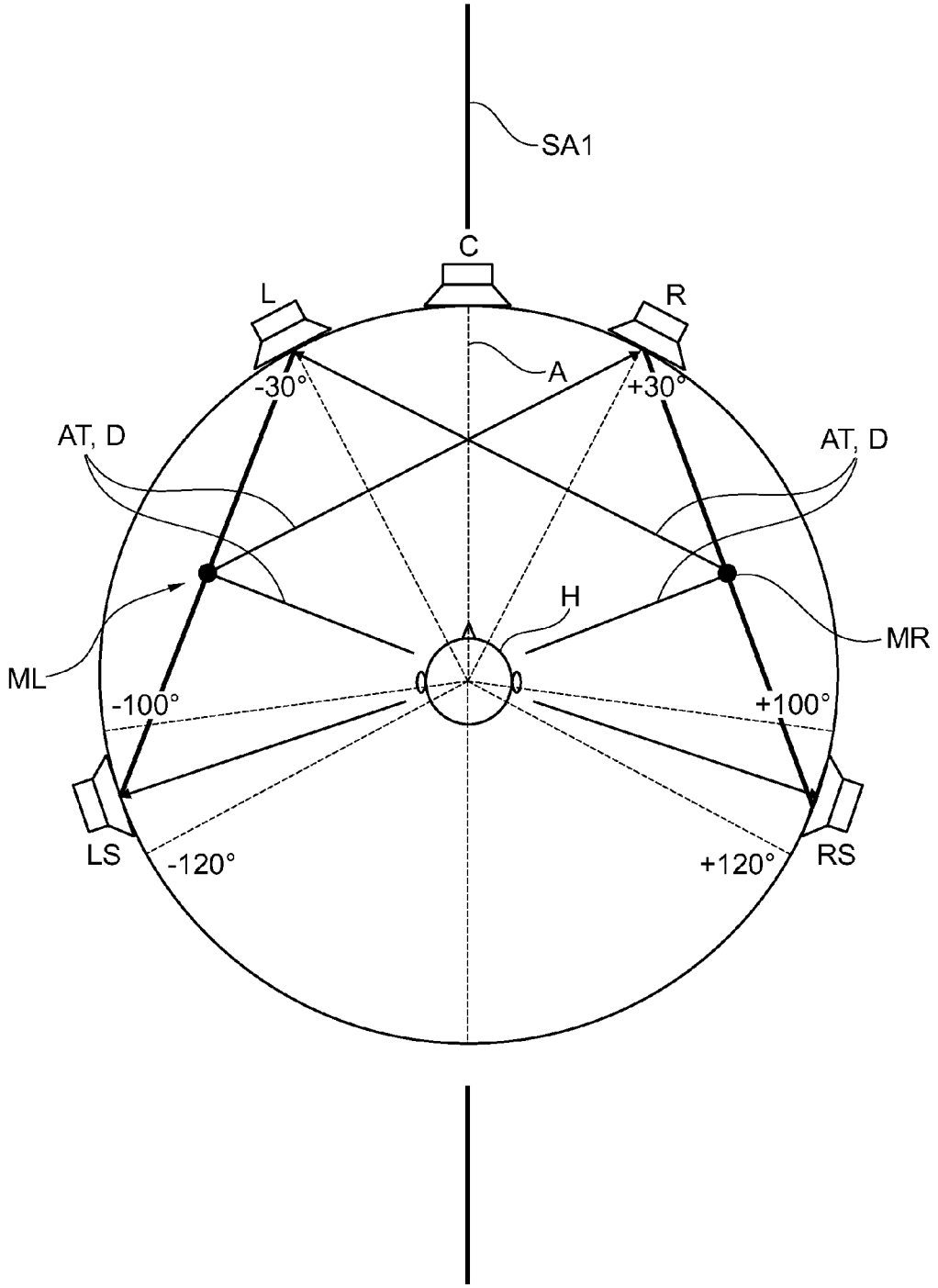
Figure 5:
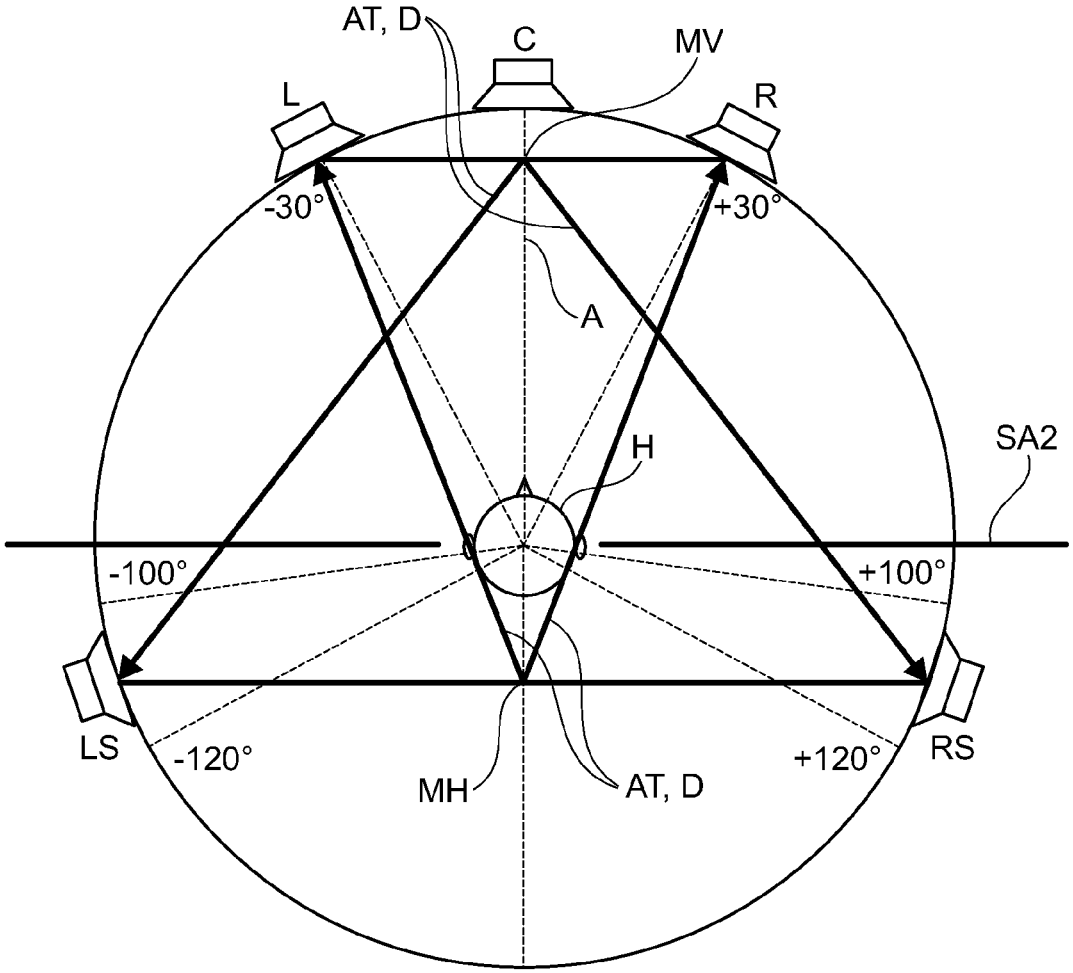

In FIG. 4, a right mono sum MR is formed from the channels of the right main loudspeaker R and of the right surround loudspeaker RS. This mono sum is attenuated by an attenuation factor AT and delayed by a delay factor D. As indicated by respective arrows, the resultant signal may be added to the channel of the left main loudspeaker L and/or to that of the left surround loudspeaker LS. The same applies to the channels of the left main loudspeaker L and the left surround loudspeaker LS. The left mono sum ML formed may be added, in an attenuated and time-delayed form, to the channel of the right main loudspeaker R and/or to the channel of the right surround loudspeaker RS. In this way, the right and left main loudspeakers R, L and the right and left surround loudspeakers RS, LS can reproduce both the channel intended for this respective loudspeaker and also the mono sum of the main and surround loudspeakers L and LS and, respectively, R and RS, which are opposite with respect to the center axis A, which corresponds to the first axis of reflection SA1.

The attenuation and delay factors AT, D that are used are preferably again within the above-mentioned ranges. Here, the values used may again correspond to those of the exemplary embodiments in FIGS. 2 and 3 or else may differ from them. A significant stabilization of the lateral localization may also be achieved in the audio reproduction system 2 illustrated by reference to FIG. 4.

As an alternative or in addition to the mixing of the channels as explained with reference to FIG. 4, the mono sum may also be reflected at the second axis of reflection SA2. This will now be explained by reference to FIG. 5.

A front mono sum MV is formed from the channels of the right and left main loudspeakers R, L. This mono sum is attenuated by an attenuation factor AT and delayed by a delay factor D. As indicated by respective arrows, the resultant signals may be added to the channel(s) of the rear left and/or right surround loudspeaker(s) LS and RS, respectively. This applies correspondingly to the rear channels of the left and right surround loudspeakers LS and RS, respectively. The rear mono sum MH formed from these channels may be added, in an attenuated and time-delayed form, to the channel (s) of the right and/or left main loudspeaker(s) R and L, respectively. As a result of these measures, the right and left main loudspeakers R, L and the right and left surround loudspeakers RS, LS can reproduce both the channel intended for this respective loudspeaker and also the mono sum, reflected in relation to the second axis of reflection SA2, of the opposite main and surround loudspeakers L and R and, respectively, LS and RS.

Figure 6:
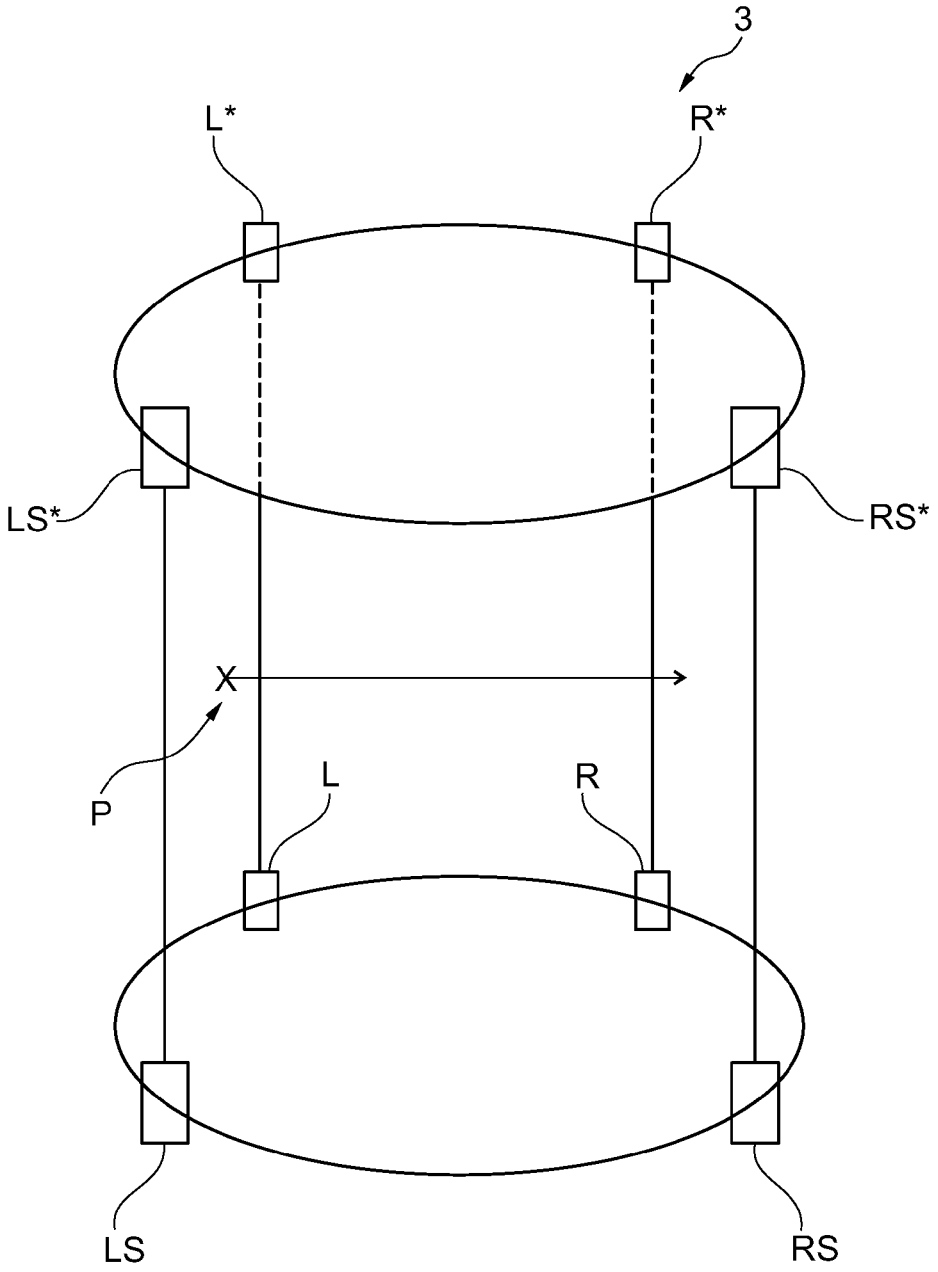
FIG. 6 shows a 3D loudspeaker arrangement of an audio system according to a further exemplary embodiment.

The previously mentioned exemplary embodiments relate to surround systems which are suitable for spatial acoustic reproduction in a 2D panoramic plane. Observing the same rules for the coupling of at least two channels, the audio reproduction system 2 according to embodiments of the invention may, however, be extended to 3D surround systems without any problems. A corresponding loudspeaker arrangement 3 is shown in FIG. 6 in a simplified perspective view.

In this loudspeaker arrangement 3, further main and surround loudspeakers R*, L*, RS*, LS* are situated above—viewed spatially—(if desired, also below, not illustrated) the main and surround loudspeakers R, L, RS, LS. In this case, the listening experience is extended by the third dimension. Phantom sound sources P can be perceived which appear to be situated above or below the panoramic plane that is spanned by the main and surround loudspeakers R, L, RS, LS. In the exemplary embodiment shown, the phantom sound source P lies above the plane concerned. The method explained above with reference to various exemplary embodiments can now be carried out not only in the panoramic plane situated, e.g., at head height of the listener. It can also be carried out in the same manner in a further plane lying above or below this panoramic plane, e.g. in the plane lying above and defined by the main and surround loudspeakers R*, L*, RS*, LS*. This allows an improved 3D surround sound impression to be obtained.

In addition to that, a plurality of planes may be taken into consideration. If the method according to aspects of the invention is carried out in a plurality of planes instead of in one plane, an image of the phantom sound source P (as indicated by a respective arrow) can, for example, be reflected on the opposite side in an attenuated and time-delayed form, rather than a horizontal or vertical stereoscopic image.

FIG. 7 shows a simplified, schematic view of an audio reproduction system 2 according to an exemplary embodiment. A main unit 4 such as, e.g., a CD or DVD player, may be suitable for generating an audio signal which comprises a plurality of channels. The channels are amplified by a suitable output stage and coupled into the loudspeakers R, L, RS, LS connected to the main unit 4. The main unit 4 furthermore comprises a processing unit 6 which may be adapted to mix at least one channel of the audio signal generated by the main unit 4 with a further channel in a time-delayed and attenuated manner, so that the mixing and/or coupling of the audio channels as described with reference to the Figures above can be achieved.

LIST OF REFERENCE NUMBERS

R right main loudspeaker
L left main loudspeaker
C center loudspeaker
RS right surround loudspeaker
LS left surround loudspeaker
A center axis
H listener
AT attenuation factor
D delay factor
SA1, SA2 axis of reflection
P phantom sound source
2 audio reproduction system
3 loudspeaker arrangement
4 main unit
6 processing unit

The invention claimed is:

1. A method of processing an audio signal intended for reproduction over a loudspeaker arrangement (3) for spatial reproduction of the audio signal, the audio signal comprising at least two pairs of stereo channels forming a first and a second stereoscopic image, wherein first and second channels of the first stereoscopic image are each time-delayed by a predetermined delay factor (D), and the volume levels of the first and the second channels of the first stereoscopic image are each attenuated by a predetermined attenuation factor (AT), and these attenuated and time-delayed stereo channels of the first stereoscopic image are added to the second stereoscopic image to provide a stereoscopic image intended for reproduction, wherein the first and the second stereoscopic images are intended for such loudspeakers (L, R, LS, RS) of the loudspeaker arrangement (3) which are opposite each other in relation to an axis of reflection (SA1, SA2) of the loudspeaker arrangement (3).

2. The method of processing an audio signal according to claim 1, wherein the audio signal comprises at least four audio channels for reproduction over loudspeakers (R, L, RS, LS) in a loudspeaker arrangement (3) suitable for quadrophony, wherein one loudspeaker (R, L, RS, LS) each of this loudspeaker arrangement (3) is provided in a respective quadrant of a coordinate system which is formed by a first axis of reflection (SA1) that is oriented in the direction of a center axis (A) and by a second axis of reflection (SA2) that is oriented transversely thereto, a first and a second channel of the respective stereoscopic image being intended for loudspeakers (R, L, RS, LS) which are provided in quadrants that are adjacent to each other in relation to one of the first and second axes of reflection (SA1, SA2).

3. The method of processing an audio signal according to claim 2, wherein the audio signal comprises at least four channels for reproduction over loudspeakers (R, L, RS, LS) in a loudspeaker arrangement (3) suitable for quadrophony, wherein the loudspeaker arrangement (3) comprises at least right and left main loudspeakers (R, L) and right and left surround loudspeakers (RS, LS) which are arranged to the right and left of a center axis (A), the channels of the main and surround loudspeakers (R, L, RS, LS) producing the first stereoscopic image are arranged on one side of the center axis (A) being added to the channels of the main and surround loudspeakers (R, L, RS, LS) arranged opposite in relation to the center axis (A), such that the first stereoscopic image is added to the second stereoscopic image for reproduction.

4. The method of processing an audio signal according to claim 2, wherein the audio signal comprises at least four channels for reproduction over loudspeakers (R, L, RS, LS) in a loudspeaker arrangement (3) suitable for quadrophony or the successor technologies thereof, wherein the loudspeaker arrangement (3) comprises at least right and left main loudspeakers (R, L) and right and left surround loudspeakers (RS, LS) which are arranged to the right and left of a center axis (A), the stereoscopic image of the main loudspeakers (R, L) being added to the stereoscopic image of the surround loudspeakers (RS, LS).

5. The method of processing an audio signal according to claim 1, wherein the audio signal comprises at least two pairs of stereo channels which, each jointly, produce the first and the second stereoscopic images, and wherein a mono sum is formed from the first and second stereo channels of a stereoscopic image, this mono sum is time-delayed by a predetermined delay factor, and the volume level of the mono sum is attenuated by a predetermined attenuation factor, and this attenuated and time-delayed mono sum of the stereoscopic image is added to at least one of the first and second stereo channels of the second channel to provide a second channel of the second stereoscopic image intended for reproduction.

6. The method of processing an audio signal according to claim 5, wherein the audio signal comprises at least four audio channels for reproduction over loudspeakers (R, L, RS, LS) in a loudspeaker arrangement (3) suitable for quadrophony, wherein the loudspeaker arrangement (3) comprises at least right and left main loudspeakers (R, L) and right and left surround loudspeakers (RS, LS), and wherein the mono sum of the stereoscopic images of the main loudspeakers (R, L) is added to at least one of the two stereoscopic images of the surround loudspeakers (RS, LS).

7. The method of processing an audio signal according to claim 5, wherein the audio signal comprises at least four channels for reproduction over loudspeakers (R, L, RS, LS) in a loudspeaker arrangement (3) suitable for quadrophony, wherein the loudspeaker arrangement (3) comprises at least right and left main loudspeakers (R, L) and right and left surround loudspeakers (RS, LS) which are arranged to the right and left of a center axis (A), and wherein the mono sum of the stereoscopic image of a main loudspeaker (R, L) situated on a first side of the center axis (A) and of a surround loudspeaker (RS, LS) situated on the same side of the center axis (A) is added to at least one of the two channels of the main and, respectively, surround loudspeakers (R, L, RS, LS) situated opposite in relation to the center axis (A).

8. The method of processing an audio signal according to claim 1, wherein the delay factor (D) is between 1.5 ms and 20 ms, preferably between 8 ms and 15 ms, further preferably between 8 ms and 10 ms, and still further preferably amounts to 10 ms.

9. The method of processing an audio signal according to claim 1, wherein the attenuation factor (AT) is between −3 dB and −12 dB, preferably between −6 dB and −9 dB, and furthermore preferably amounts to one of −6 dB and −9 dB.

10. An audio reproduction system (2) comprising a loudspeaker arrangement (3) for spatial reproduction of an audio signal, and a processing unit (6) for processing the audio signal having at least first and second channels producing at least a first and a second stereoscopic image, wherein a first and a second channel of the first stereoscopic image are intended for reproduction over different ones of loudspeakers (R, L, RS, LS) of the loudspeaker arrangement arranged spatially at a distance, wherein the processing unit (6) is designed to time-delay the first and the second channel of the first stereoscopic image by a predetermined delay factor (D) and to attenuate a volume level of the first and the second channel of the first stereoscopic image by a predetermined attenuation factor (AT) and to add this attenuated and time-delayed first and second channel to a first and a second channel of the second stereoscopic image to provide an audio signal intended for reproduction, wherein the first and the second stereoscopic images are intended for such loudspeakers (L, R, LS, RS) of the loudspeaker arrangement (3) which are opposite each other in relation to an axis of reflection (SA1, SA2) of the loudspeaker arrangement (3).

11. A processing unit for conditioning audio signals, comprising an input for receiving an audio signal having at least two pairs of stereo channels, which produce a first and a second stereoscopic image and comprising a unit for processing the audio signal which is designed to time-delay a first and a second channel of the first stereoscopic image by a predetermined delay factor (D) and to attenuate a volume level of the first and the second channel of the first stereoscopic image by a predetermined attenuation factor (AT) and to add this attenuated and time-delayed first and second channel of the first stereoscopic image to respective first and second channels of the second stereoscopic image to provide at an output an audio signal intended for reproduction, wherein the first and the second stereoscopic images are intended for such loudspeakers (L, R, LS, RS) of the loudspeaker arrangement (3) which are opposite each other in relation to an axis of reflection (SA1, SA2) of the loudspeaker arrangement (3).

* * * * *